US006729844B2

(12) United States Patent
Bettencourt

(10) Patent No.: US 6,729,844 B2
(45) Date of Patent: May 4, 2004

(54) CONTROLLER FOR VARIABLE PITCH FAN SYSTEM

(76) Inventor: Harold Ray Bettencourt, 96159 Gravelford Rd., Myrtle Point, OR (US) 97458

( * ) Notice: Subject to any disclaimer, the term of this patent is extended or adjusted under 35 U.S.C. 154(b) by 2 days.

(21) Appl. No.: 10/218,417

(22) Filed: Aug. 14, 2002

(65) Prior Publication Data

US 2004/0033136 A1 Feb. 19, 2004

(51) Int. Cl.[7] ..... F04D 29/36

(52) U.S. Cl. ..... 416/1; 416/36; 416/37; 416/39; 416/42; 416/156; 416/169 A

(58) Field of Search ..... 416/1, 36, 37, 416/39, 42, 147, 155, 156, 159, 169 A

(56) References Cited

U.S. PATENT DOCUMENTS 4,135,854 A * 1/1979 Binstock et al. ..... 416/37
6,071,076 A 6/2000 Ansari et al.
6,109,871 A * 8/2000 Nelson et al. ..... 416/36
6,113,351 A 9/2000 McCallum et al.
6,253,716 B1 7/2001 Palmer et al.
6,592,328 B1 * 7/2003 Cahill ..... 416/155

* cited by examiner

*Primary Examiner*—Ninh H. Nguyen
(74) *Attorney, Agent, or Firm*—Grrer, Burns, & Crain, Ltd.

(57) ABSTRACT

An electronic control device for opening and closing valves in a valve assembly that actuates a variable pitch fan system capable of operating in a plurality of fan blade pitch positions including a temperature switch actuated in response to a temperature condition of the engine, a pressure switch in series with the temperature switch and actuated in response to a pressure condition of the variable pitch fan system, and a time delay relay control in parallel with the temperature switch and the pressure switch for transmitting a timed signal therefrom. The device also includes a first solenoid in series with the pressure switch, a second solenoid in series with the time delay relay control and connected to the first solenoid, and wherein transmission of at least one of the timed signal, the temperature condition signal, and the pressure condition signal opens or closes the valves of the valve assembly of the variable pitch fan system.

19 Claims, 5 Drawing Sheets

FIG. 3
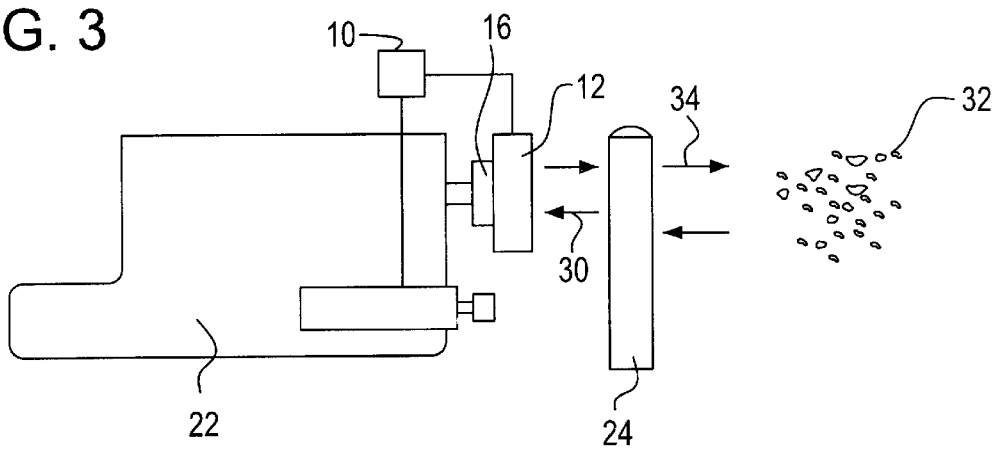
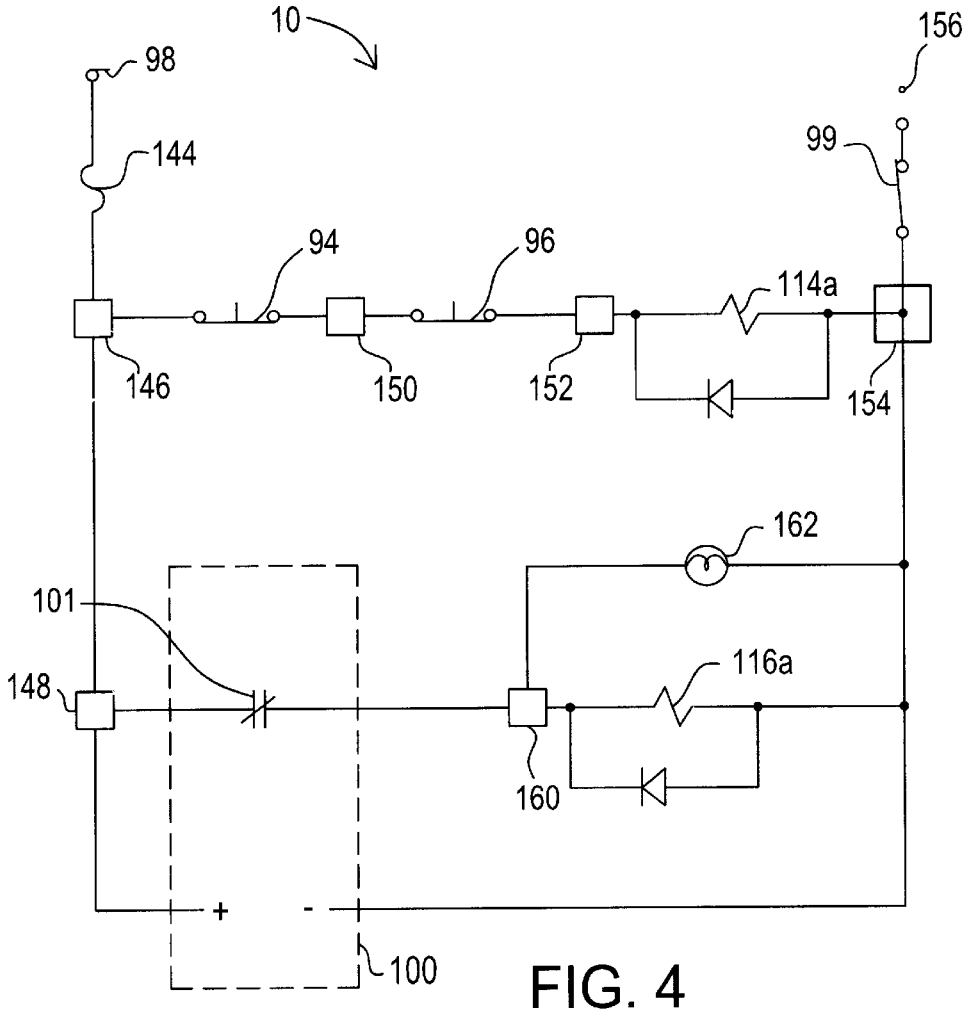
FIG. 4

CONTROLLER FOR VARIABLE PITCH FAN SYSTEM

BACKGROUND OF THE INVENTION

The present invention relates to a controller for a variable pitch fan system, and more particularly to an electronic control device for selectively controlling a pitch of a variable pitch fan of the type capable of operating in a plurality of blade pitch positions, such as at least a neutral blade pitch position, a cooling blade pitch position, and a purge blade pitch position. The instant invention also relates to a method of selectively controlling a pitch of a variable pitch fan of the type capable of operating in a plurality of blade pitch positions, such as at least a neutral blade pitch position, a cooling blade pitch position, or a purge blade pitch position for controlling a direction of air flow to and from a cooling core.

Farms, feedlots, and other agricultural plots, as well as construction sites, mining sites, and other sites, are susceptible to producing large amounts of fine, particulate, airborne debris. These conditions present a problem for operators of agricultural vehicles such as trucks equipped with feed mixer bodies, tractors, bale pick up machines, silage baggers, composting machinery, bale grinding equipment and forage harvesters. As will be appreciated by those skilled in the art, a feed mixer body is a container having at least one agitator for mixing a plurality of livestock feeds to obtain a substantially uniform livestock feed mixture. Because these vehicles operate virtually non-stop, twenty-four hours a day, the cooling cores (e.g., radiators, oil coolers, air conditioning condensers, and heat exchangers) are constantly exposed to vast amounts of particulate debris. Because cooling fans ordinarily draw air in through the cooling core in a single constant direction to facilitate cooling of the fluid within the cooling core, the vehicle cooling cores often become clogged with debris when used in areas having high airborne particulate matter concentrations. Consequently, the engines of the vehicle may become overheated.

Similarly, in the recreational vehicle industry, there is a need for optimizing a fan actuating mechanism for cooling efficiency. In order to maximize energy efficiency of the cooling systems in recreational vehicles and the like are typically configured so that a fan is only actuated within very close temporal proximity to the time the motor has reached a maximum operating temperature, and will otherwise be shut down. A typical clutch fan is actuated by an engine electronic control module that is actuated by signals directly relating to vehicle temperature and other parameters that are hard coded into the engine electronic control module for activation. When actuated, these fans consume up to 50 engine horsepower. Since the timing of fan activation cannot be changed in the engine electronic control module by the vehicle operator, many of the manufacturers of recreational vehicles have incorporated direct drive fan systems, which is undesirable because it continually consumes up to 50 engine horsepower.

One known method for the removal of debris from the cooling cores of vehicles and other equipment operating in areas having high airborne particulate matter concentrations include requiring the vehicle or equipment operator to periodically interrupt his work, exit the cab of the vehicle, and manually clean out the debris-filled cooling core. Unless the operator periodically removes the debris in such a manner, the cooling core will become clogged, increasing the likelihood that the engine may consequently overheat or otherwise become inoperable.

A main drawback of manual removal of radiator debris is that the operator who is engaged in the task of distributing feed to livestock, for example, must periodically cease his operations to manually clear the cooling core of debris. Thus, manual removal of debris is time consuming and detracts from optimal work output of the operator. Moreover, this method subjects the operator to inclement weather, when present.

Another drawback of the above-identified conventional methods is that the operator must rely on memory to periodically remove the debris from the cooling core. If the operator neglects to remove the debris, the cooling core can quickly become clogged and cause damage to the engine.

Still another drawback of manual removal of debris is that the operator is subjected to hazards associated with cleaning the cooling cores. For example, the cooling cores can be heated to high temperatures, and are typically in close proximity to the extreme heat of the vehicle's engine.

Yet another drawback of manual removal is that the equipment surrounding the cooling cores are susceptible to damage by the operator as the operator attempts manual removal. An example of this kind of damage is damage that may result to the cooling fins as manual removal is conducted.

Variable pitch fans are well known in the art, wherein fan blades of the variable pitch fan are capable of rotational movement to alter the pitch of the fan blade, and accordingly vary the direction of air flow through the fan blade. Examples of these variable pitch fans are those disclosed in U.S. Pat. No. 6,113,351, which is incorporated herein by reference and discloses a hydraulically powered variable pitch fan. U.S. Pat. No. 6,253,716 B1, which is incorporated herein by reference, discloses a pneumatically powered variable pitch fan.

In the '716 patent, an actuator member is connected to each of the axially rotatable fan blade stems with a linkage configured so that linear movement of the actuator member causes axial rotation of the stems. The actuator member is biased to a first position by a spring. The first position represents one rotational extreme of the fan stems. A pneumatically-operated diaphragm is configured to engage the actuator member on an opposite side from the spring. Upon sufficient air pressure exerted against the diaphragm, the force exerted by the springs is overcome causing the stems to rotate to a second position. The amount of pitch may vary to achieve partial stem rotation.

A still further object of the invention is to provide an electronic control system for a variable pitch fan assembly that features the ability of detecting predetermined parameters and then signaling a valve assembly to alter the pitch of the variable pitch fan assembly.

BRIEF SUMMARY OF THE INVENTION

The instant invention is directed to a method of selectively controlling a pitch of a variable pitch fan of the type capable of operating in a plurality of blade pitch positions, such as a at least a neutral blade pitch position, a cooling blade pitch position, and a purge blade pitch position for controlling a direction of air flow to and from a cooling core. The method includes the step of setting a predetermined parameter for temperature at a predetermined location, setting a predetermined parameter for air conditioner system pressure, and setting a predetermined parameter for time. In addition, the method detects when one of the predetermined parameters is reached, and signals at least one valve when one of the predetermined parameters is reached. Moreover, the method includes the step of energizing the at least one valve to alter the pitch of the variable pitch fan.

The instant invention is also directed to an electronic control device for selectively controlling a pitch of a variable pitch fan of the type energized by a valve assembly and capable of operating in a plurality of positions, such as at least a neutral blade pitch position, a cooling blade pitch position, and a purge blade pitch position, and includes a temperature detecting means for detecting a predetermined temperature at a predetermined location, and a pressure detecting means for detecting a predetermined pressure in an air conditioning system. The device also has a timer detecting means for detecting a predetermined time period, and a signaling means for signaling the valve assembly when a predetermined temperature, pressure or time period has been reached. The device further includes an energizing means for energizing the valve assembly.

The present invention further includes an electronic control device configured for altering the direction of air flow in response to factors relating directly to an increased temperature within the cooling core caused by debris accumulation or other factors. The electronic control device varies a pitch of a variable pitch fan assembly based on various parameters, such as a lapsing of a predetermined period of time, a detected increase in temperature at a predetermined location, or an increase in pressure within an air conditioning system.

BRIEF DESCRIPTION OF THE DRAWINGS

FIG. 3 is a schematic diagram of the fan assembly operating in a sample environment.

FIG. 4 is a circuit diagram of the circuitry operating the instant electronic control device.

DETAILED DESCRIPTION OF THE INVENTION

Figure 1:
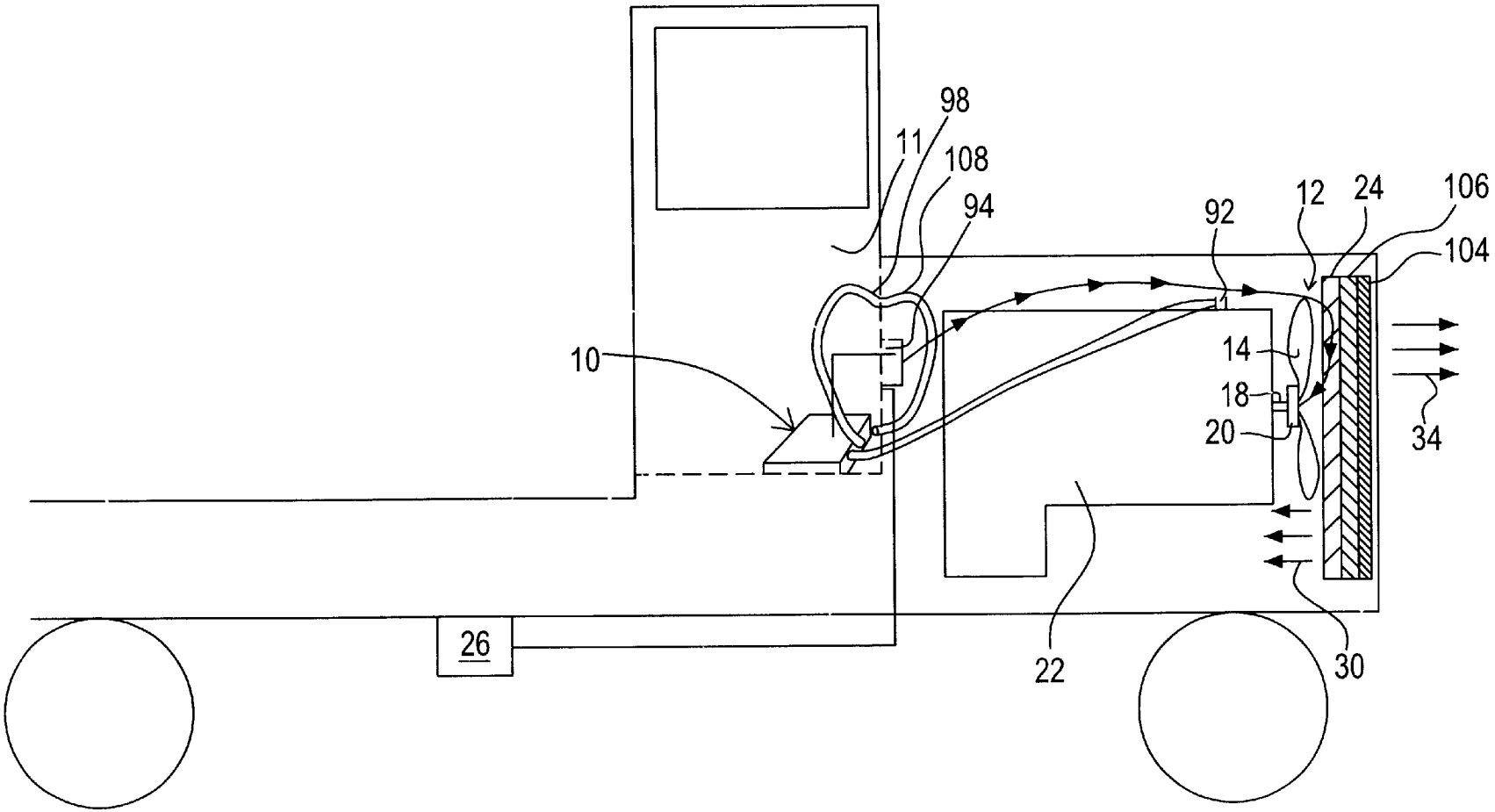
FIG. 1 is a schematic diagram of the instant electronic control device illustrated with an environment in which the instant electronic control device may be used.

Referring now to FIG. 1, an electronic control device, indicated generally at 10, is capable of operating in conjunction with conventional variable pitch fan assemblies, such as those actuated by hydraulic power or pneumatic power. Typically, the electronic control device 10 is mounted in the cab of a vehicle 11, but can be placed in any location on the chassis as well. By way of example only, the instant electronic control device 10 will be shown in connection with a variable pitch fan assembly indicated generally at 12. However, the instant invention contemplates use with numerous additional variable pitch fan assemblies.

Figure 2:
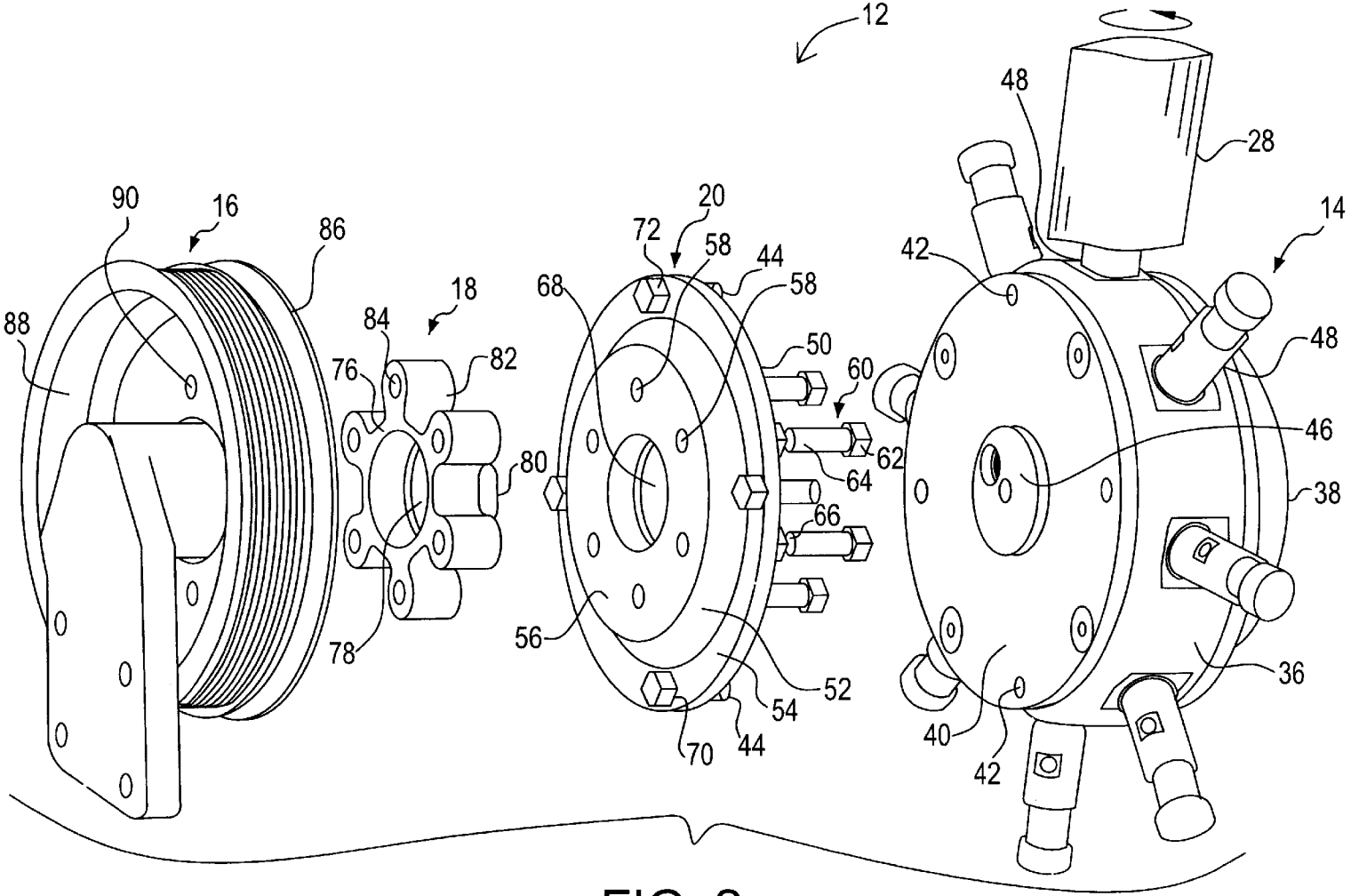
FIG. 2 is an exploded perspective view of the fan assembly used in conjunction with the instant invention.

As best illustrated in FIGS. 2 and 3, the variable pitch fan assembly 12 includes a variable pitch fan 14, a fan drive 16, a spacer 18, and an adapter plate 20. The fan 14 itself may further include a fan acutator (not shown). A suitable variable pitch fan 14 is described in U.S. Pat. No. 6,253,716 B1, which is incorporated by reference. The variable pitch fan assembly 12 is adapted for use in connection with an internal combustion engine of the vehicle 11, which is ordinarily cooled by a radiator that is in fluid communication therewith. Therefore, FIGS. 1 and 3 also depict an engine 22 and a radiator 24 to better illustrate the operation of the variable pitch fan assembly 12. The radiator 24 provides for cooling of the engine 22 as is known to those skilled in the art. Both the fan assembly 12 and a source of compressed air 26 are in fluid communication with the electronic control device 10.

The variable pitch fan 14 is driven by the engine 22 of the vehicle 11 via the fan drive 16, and includes a plurality of bladelike fins 28 (best seen in FIG. 2) which are moveable between a plurality of pitch positions for selectively directing the flow of air through the fan assembly 12. For example, in vehicles where the engine 22 is mounted at the front of the vehicle 11, a fan ordinarily operates to cool the engine by drawing air external to the vehicle over and through the radiator 24, thereby cooling the coolant within the radiator, which cools the engine by circulating therethrough. The variable pitch fan 14 is capable of operating in a first blade pitch position to facilitate cooling of the engine 22, wherein air is drawn through the radiator 24 and through the fan assembly 12, in the direction represented by arrows 30. Because the first blade pitch position is frequently used to facilitate cooling of the engine 22, it may be referred to as the full cooling blade pitch position. In this first blade pitch position, as air is drawn into the engine, particulate debris 32 suspended in the ambient air, for example, dust, hay chaff, cotton seeds, bark, leaves and wood shavings, is also drawn into the radiator 24 along with the air, where it begins to accumulate. Over time, this debris 32 can clog the radiator 24, thereby causing the engine 22 to overheat.

To combat overheating of the engine 22, the present variable pitch fan 14 is configured for operating in a second blade pitch position indicated by arrows 34, wherein the direction of air flow through the radiator 24 is opposite to the direction of air flow hen the fan is in its first blade pitch position. In this second blade pitch position 34, the variable pitch fan 14 draws air away from the engine 22 and toward the radiator 24, which in turn expels the particulate debris 32 away from the radiator. Because particulate debris 32 is purged from the radiator 24, the second blade pitch position is frequently referred to as the full purge blade pitch.

Since vehicle engines do not require any cooling until a certain engine temperature is reached, the variable pitch fan illustrated for use with the instant invention also provides a third blade pitch position, which is usually a neutral blade pitch position, wherein air is neither pushed away from the engine, nor drawn toward the engine. However, the third blade pitch position may optionally be defined as any degree of blade pitch between full purge blade pitch position and full cooling blade pitch position, depending on the specifications of the particular manufacturer. By way of example only, the instant embodiment defines the third blade pitch position as the neutral blade pitch position, wherein debris intake is minimized because a fan in neutral blade pitch position moves little to no air in either direction through the cooling cores. The neutral blade pitch position is the normal operating condition of the blade pitch position.

Referring again to FIG. 2, the variable pitch fan 14 includes a housing 36, a generally circular front housing surface 38, a generally circular rear housing surface 40, and a plurality of threaded recesses 42. Preferably, there are four threaded recesses 42 that are configured to receive threaded fasteners 44. An axially extending, preferably cylindrical boss portion 46 is integrally formed with and disposed central to the surface 40 of the variable pitch fan 14. Upon assembly, the cylindrical boss portion 46 centers the fan 14 on the fan assembly 12. A plurality of blade spindles or stems 48 radially extend from the housing 36, and are configured to rotate within the housing. Mounted on each blade spindle 48 is a fan blade 28, which is configured to be secured to, and to rotate with the corresponding blade spindle.

The adapter plate 20 includes a front surface 50 and a rear surface 52. In addition, the adapter plate 20 also includes an outer flanged circumference 54 and an inner raised planar circumference 56, which extends axially from a plane defined by the adapter plate 20. Spaced along the inner raised planar circumference 56 of the adapter plate 20 is a plurality of apertures 58. Each aperture 58 is configured to receive a partially threaded fastener 60 that has a head portion 62, a shank portion 64, and a partially threaded portion 66. Central to the adapter plate 20 is a large aperture 68, which matingly engages the upwardly extending cylindrical boss portion 46 of the variable pitch fan 14. This engagement acts as a fan pilot and ensures proper alignment and balancing of the fan 14 during rotation.

A plurality of apertures 70 are also spaced along the outer flanged circumference 54 of the adapter plate 20 for receiving individual ones of the threaded fasteners 44. A head portion 72 of each of the fasteners 44 is sized to have a diameter larger than a diameter of each of the respective apertures 70. Thus, the adapter plate 20 is mounted to the variable pitch fan 14 via engagement of the threaded fasteners 44 through the apertures 70 in the outer flanged circumference 54 with the plurality of recesses 42 on the rear surface of the fan 14 that are configured for threadedly receiving the fasteners.

The spacer 18 is included to maintain an appropriate distance between the variable pitch fan 14 and the radiator 24, which maximizes air flow through the fan. The spacer 18 has a front surface 74, a rear surface 76, and a center aperture 78 for receiving the centering fan pilot of the fan drive 16, which centers the mounted fan 14 to achieve the necessary fan balance when rotating. Integrally formed with the front surface 74 is an axially extending rim wall 80 having a circumference that is defined by a circumference of the center aperture 78. The axially extending rim wall 80 frictionally engages the larger aperture 68 of the adapter plate 20, thereby fixing the adapter plate to the spacer 18. Generally cylindrical lobe members 82 have corresponding throughbores 84 that are circumferentially spaced around the center aperture 78, and are preferably integrally formed with the spacer 18.

The fan drive 16 also has a front surface 86 and a rear surface 88. The front surface 86 includes a raised generally cylindrical member (not shown) and a plurality of apertures 90 in alignment with the apertures 58 of the adapter plate 20 and the apertures 84 of the spacer 18.

Thus, the assembled variable pitch fan assembly 12 includes the variable pitch fan 14, the adapter plate 20, and the spacer 18 mounted to the fan drive 16. Each component is mounted to the next to ensure that the fan is centered and balanced during rotation. The threaded fasteners 44 engage the apertures 70 along the outer circumference of the adapter plate 20, and the fasteners 44 are prevented from passing entirely through the apertures by the head 72 of the fastener 44 abutting the rear surface 52 of the adapter plate. The fasteners 44 threadedly engage the recesses 42 on the rear surface 40 of the variable pitch fan 14.

Similarly, the fasteners 60 extend through the apertures 58 spaced along the inner raised planar circumference 56 of the adapter plate 20, and are prevented from passing entirely through the apertures 58 by the abutment of the head 62 against the rear surface 52 of the adapter plate. The shafts 64 continue to extend through the apertures 84 of the spacer 18, and the threaded portions 66 threadedly engage apertures (not shown) corresponding the apertures 58 of the adapter plate 20 and the apertures 84 of the spacer 18. In this way, the variable pitch fan 14 is mounted to the adapter plate 20, which is in turn ultimately mounted to the fan drive 16 through both the adapter plate and the spacer 18.

Turning now to FIG. 4, the electronic control device 10 of the instant invention controls the blade pitch position of the variable pitch fan assembly 12 in response to one or several predetermined parameters. These parameters may include a predetermined temperature detected at a predetermined location, a predetermined change in pressure within an air conditioner system, or the lapsing of a predetermined period of time. Additionally, the instant electronic control device allows an operator may manually override the predetermined parameters to effect a predetermined fan blade pitch. The electronic control device 10 may be connected to a valve assembly, designated generally at 92, for controlling a flow of fluid. In turn, the valve assembly 92 may be coupled to the variable pitch fan 14 to energize the variable pitch fan upon selective activation of the valve assembly by the electronic control device 10. The valve assembly 92 is also fluidly coupled to the source of compressed air 26.

Several switches may be selectively activated to actuate the variable pitch fan assembly 12. Optionally, a temperature switch 94 may be activated by the detection of the predetermined temperature at the predetermined location. Alternatively, an air conditioner pressure switch 96 may be activated by detection of the predetermined change in pressure within the air conditioner system. A power switch 98 (see FIG. 1) is also preferably provided with the instant electronic control device 10 to control electric current flow thereto. The power switch 98 is usually electrically coupled to a vehicle ignition or other manually operated power systems. A full override switch 99 that is normally closed may also be provided with the instant invention. Also, a timer device or time delay relay control 100 may be provided with the instant electronic control device 10. The timer device 100 is equipped with internal circuitry to monitor a plurality of parameters, such as a time duration of fan in a reversed pitch position and a duration of time between fan pitch position reversal. A relay contact 101 within the timer device 100 may be selectively activated or deactivated to actuate the timer device.

Activation of the switches 94, 96, 98, 99 or the activation of the timer device 100 accordingly results in selective activation of the valve assembly 92, which ultimately results in changes of blade pitch position of the variable pitch fan 14. While the switches 94, 96, 99 and the timer device 100 may communicate with the valve assembly 92 in numerous manners. In one embodiment the circuitry, including a plurality of relays, may be provided for conveying electrical impulses to the valve assembly 92.

According to one embodiment of the instant invention, the temperature switch 94, air conditioner pressure switch 96, power switch 98, full override switch 99, and timer device 100 are all electrically connected to the plurality of relays for activating and deactivating the switches 94, 96, 99. The outgoing signals subsequently signal the valve assembly 92 to respond accordingly. The power switch 98 is typically linked to an operator controlled system, such as a vehicle ignition. Thus, when an operator turns the vehicle 11 on, the power switch is typically activated.

To this end, each switch 94, 96, 99 typically includes a sensing means capable of sensing respective predetermined parameters and signaling the respective switches to respond accordingly. For example, as illustrated in FIG. 1, the temperature switch 94 is preferably interfaced to a predetermined location, such as an engine 22, and includes a temperature sensing means (not shown), which detects temperature and is linked to a temperature measuring means (not shown), which is also typically included in the temperature switch to measure the temperature at the predetermined location. As those skilled in the art will appreciate, the temperature sensing means are typically rated to activate or deactivate according to a predetermined set of parameters. The temperature switch 94 may be an integral portion of the electronic control device 10 or formed as a separate connectible unit. In one embodiment, the temperature sensing means is a thermocouple.

In one embodiment of the instant invention, the temperature switch 94 is coupled to an engine block for measuring the temperature of the engine 22. However, it is contemplated that the temperature switch 94 could be coupled to any number of predetermined locations, such as an oil cooler, the engine radiator 24, a heat exchanger, an air conditioner condenser 104 (see FIG. 1) or the air charge cooler 106 (see FIG. 1). In FIG. 1, the radiator 24 is illustrated with both the air conditioner condenser 104 and the air charge cooler 106. However, the air conditioner condenser 104 and air charge cooler 106 are optional for use with the instant invention. The temperature sensing means is electrically connected to the temperature measuring means and senses when a predetermined temperature has been reached or exceeded by the engine block. For example, the temperature sensing means may be configured to activate the temperature switch 94 when the temperature sensing means detects a threshold temperature of 150° F. or greater from the temperature measuring means. Typically, temperatures ranging from 150° to 210° may be selected as the predetermined temperature parameter to be detected. Upon detecting the threshold temperature, the temperature sensing means signals the temperature switch 94 to deactivate the temperature switch.

Similarly, the air conditioner pressure switch 96 is commonly known in the art as a high pressure switch and typically includes a pressure sensing means (not shown). In turn, the pressure sending means is linked to a pressure measuring means (not shown). As those skilled in the art will appreciate, the pressure sensing means typically includes a predetermined range for activation or deactivation the air conditioner pressure switch 94. The air conditioner pressure switch 96 may either be an integral portion of the electronic control device 10, or formed separately therefrom. In one embodiment, the air conditioner pressure switch is coupled to the vehicle's air conditioner system to monitor pressure within the system. When a predetermined increase in pressure is measured by the pressure measuring means, the pressure sensing means detects the increase and signals the air conditioner pressure switch 96 deactivate. The manufacturer may designated any predetermined pressure condition to be monitored, which typically ranges from between 250 psi and 350 psi. In one embodiment, the pressure sensing means may be configured to activate the air conditioner pressure switch 94 when the pressure sensing means detects a threshold pressure of 250 psi or greater from the pressure measuring means.

The full override switch 99 is a manual control that may be actuated by an operator by pushing a button or toggle, or flipping a switch, for example. The full override switch 99 permits an operator to manually open the circuit at any time, thereby preventing electric current from activating the valve assembly 92.

The switches 94, 96, 99 are preferably configured to be in normally closed positions, so that when electric current is supplied from the power source 98, electric current flows from the power source through the electronic control device 10 to energize the valve assembly 92. Opening either of the temperature or air conditioner pressure switches 94, 96 shorts a first solenoid 114*a*, which the controls the pitch of the variable pitch fan 14 in conjunction with a second solenoid 116*a*. In one embodiment, the first solenoid 114*a* is a low pressure solenoid, and the second solenoid 116*a* is a high pressure solenoid.

Figure 5:
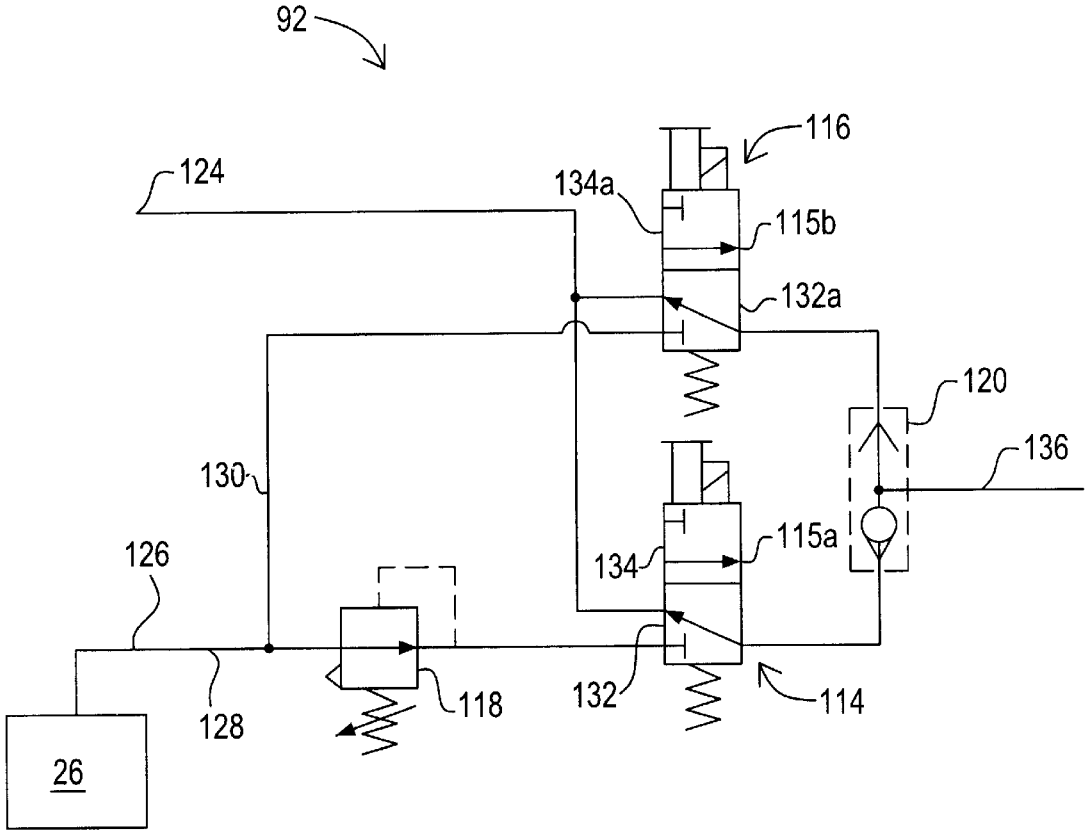
FIG. 5 is a schematic diagram of the valve assembly actuated by the instant electronic control device.

Turning now to FIG. 5, the valve assembly 92 operated by the instant electronic control device 10 may be pneumatically or hydraulically powered. By way of example only, the preferred electronic control device 10 is illustrated with a pneumatically-powered valve assembly 92 having a first valve 114, which is a low pressure fan solenoid control valve, and a second valve 116, which is a normally open high pressure fan solenoid control valve. Within each of the first and second valves 114, 116 are the respective pressure solenoids 114*a*, 116*a* (see FIG. 4), which are connected to the electronic control device 10. The valve assembly 92 further includes a pressure regulator 118, a shuttle valve 120, and a tee valve 122, all of which are connected to enable air flow through the valve assembly 92. The source of compressed air 26 is coupled to the valve assembly 92. In one embodiment, the illustrated pressure regulator 118 is a 40 psi regulator. Similarly, the first valve 114 is a 40 psi valve and the second valve 116 is a 120 psi valve. Both the first and second valves 114, 116 are normally open and in fluid communication with a single exhaust air out passageway 124, through which compressed air supplied by the source of compressed air 26 flows when the first and second valves are in the normally open position.

The first and second valves 114, 116 are also in fluid communication with the shuttle valve 120. Activation of the first solenoid 114*a* causes the respective first valve 114 to close. Similarly, activation of the second solenoid 116*a* causes the second valve 116 to close. In their respective closed positions, rather than expelling air through the exhaust air out passageway 124, the first valve 114 will direct air through a first valve outlet port 115*a* and the high pressure solenoid control valve 116 will direct air through a high pressure outlet port 115*b*. The first valve outlet port 115*a* and second valve outlet ports 115*b* are in fluid communication with the shuttle valve 120, which will be displaced according to whether the first valve 114 and/or the second valve 116 are open or closed.

The pitch positions of variable pitch fans 14 typically includes three benchmark positions: a full cooling blade pitch position where air is directed through the fan in a first direction, a neutral blade pitch position where air is neither pulled nor pushed through the fan, and a full purge blade pitch position, with air being directed through the fan in a second direction, generally opposite to the first direction. Depending on the application, the cooling position may be defined as either a full push blade pitch position or a full pull blade pitch position, and the full purge blade pitch position is then accordingly defined as the blade pitch position generally opposite to either the full pull blade pitch position or the full purge blade pitch position.

By way of example only, in a vehicle 11 where the engine is mounted under the hood of the vehicle, a cooling position is typically achieved by pulling air through the radiator and the fan toward the engine. Conversely, in a vehicle where the engine is mounted at the rear of the vehicle, a cooling position is typically achieved by pushing air through the radiator and the fan and then toward the engine. Moreover, in stationary engines, such as the engines used to operate large buildings, whether a cooling position is a push position or a pull position depends on the configuration of the engine as determined by the manufacturer for purposes of cooling. A purge position, as defined herein, is the opposite position of the assigned cooling position. The assigned cooling position may be either the pull or push position. The instant invention contemplates use with fans having either a push or a pull configuration.

As illustrated in FIG. 5, the source of compressed air 26 provides an air supply via an air supply intake 126 at a predetermined pressure, for example 120 psi. Once the compressed air has been emitted from the source of compressed air 26, it travels through a first passageway 128 to a second passageway 130, and the pressure regulator valve 118, which is set to a predetermined pressure, for example 40 psi. The incoming compressed air usually has an air pressure of about 120 psi, which exceeds the predetermined pressure point of the regulator valve 118, which opens to allow compressed air flow through the regulator valve and to the first valve 114. The first valve 114 may be a 2-position, 3-way valve having an open position 132 and a closed position 134.

When both the first and second valves 114, 116 are in the open position, full system air is expelled from the exhaust passageway 124 and no compressed air flows to the shuttle valve 120. Accordingly, the shuttle valve 120 is not displaced in either direction. When the shuttle valve 120 is not displaced, the fan actuator may be configured for altering the fan blade pitch position to a predetermined blade pitch position, such as full cooling blade pitch position.

While the first valve 114 is in the open position 132, the compressed air is prevented from reaching the shuttle valve 120 from the first valve. When the first valve is in the closed position 134, the pressurized air may flow to the shuttle valve 120. If the second valve 116 is open, the higher pressure of the compressed air flowing from the first valve 114 will displace the shuttle valve 120 in the direction of travel of the compressed air from the first valve 114, allowing the compressed air from the first valve to continue to the fan actuator. For example, if the source of compressed air 26 were delivering compressed air at 120 psi, 40 psi compressed air reaches the fan actuator of the fan assembly 12 after passing through the first valve 114. Displacement of the shuttle valve in the direction of air travel from the first valve 114 being open drives the variable pitch fan 14 at a predetermined pitch position. For example, the fan actuator may be configured so that displacement of the shuttle valve in the direction of air travel with the first valve 114 being open causes the fan 14 to operate in a neutral blade pitch position, where air is neither pulled nor pushed through the fan.

As discussed above, there is a pressure difference between the air flowing from the compressed air source 26 and the air downstream of the regulator valve 118. In the present embodiment, this difference is 80 psi. Therefore, air travels through the second passageway 130 unless the second valve 116 is in an open position 140. The second valve 116 operates in the normally open position 140, but can be positioned in a closed position 142. In the normally open position 140, compressed air is prevented from reaching the shuttle valve 120. Alternatively, when the second solenoid 116*a* activates the second valve 116 to close, the second passageway 130 allows the compressed air from the compressed air source 26 to flow to the fan actuator when the second valve is in the closed position 142.

Similar to the first valve 114, the second valve 116 may be a two-position, three-way valve having an open position 132*a* and a closed position 134*a*. Closing the second valve 116 will cause the compressed air to flow through the second passageway 130 rather than from the first passageway 128 to the regulator valve 118. If the second valve 116 is closed while the first valve 114 is open, the full 120 psi of compressed air will flow to the shuttle valve 120 and displace the shuttle valve in the direction of air travel determined by the second valve. Even if both the first and second valves 114, 116 are closed, the second valve will emit compressed air at a higher pressure than the air from the first valve, resulting in the shuttle valve 120 being displaced due to the flow of air from the second valve. Thus, when the second valve 116 of the instant embodiment is closed, the shuttle valve 120 will be displaced based on the direction of air flow from the second valve. The fan actuator may accordingly be configured so that displacement of the shuttle valve 120 causes the fan blades 28 to move to a predetermined blade pitch position, such as the full purge blade pitch position.

Thus, in operation, the electronic control device 10 operates to either activate or deactivate one or both of the first and second solenoids 114*a*, 116*b* to cause one or both of the first and second valves to open and close, which consequently affects the pitch or position of the variable pitch fan 14. In the illustrated embodiment, when there is no displacement of the shuttle valve 120, a full cooling blade pitch position is effected, whereas displacement of the shuttle valve in the direction of air travel from the second valve 116 effects a full purge blade pitch position, and displacement of the shuttle valve in the direction of air travel from the first valve 114 effects a neutral blade pitch position.

As best illustrated in FIGS. 4 and 5, when system power is provided to the electronic control device 10 via vehicle ignition or other means, a signal is provided by the electronic control device. When the switches 94, 96, 99 are in the normally closed position, the signal, which is preferably generated by a 12-volt battery power source, which provides electrical current that passes through a 2-amp fuse 144 and to the temperature switch 94, the air conditioner pressure switch 96, the timer device 100, and the full override switch 99. The electronic control device 10 is connected to the valve assembly 92 to control opening and closing of valves 114, 116 of the valve assembly.

More specifically, in one embodiment of the instant invention illustrated in FIG. 4, power is supplied via a vehicle's battery once the vehicle's ignition is activated. Electric current provided by the 12-volt battery flows through the fuse 144 and into a first relay 146, which is connected to a second relay 148 in parallel to the temperature switch 94. Therefore, electric current passes through the fuse 144 and may flow through the first relay 146 to the second relay 148 and/or the temperature switch 94 under certain circumstances, described below.

Because the temperature switch 94 is in its normally closed position, electric current supplied to the temperature switch from the first relay 146 usually flows through the temperature switch to a third relay 150. The third relay 150 is connected in series to the air conditioner pressure switch 96, which is also normally closed. Electric current is thus free to flow from the third relay 150, through the air conditioner pressure switch 96 and to a fifth relay 152, which is normally closed. The fifth relay 152 is connected in series to the first solenoid 114*a*, and thus electric current flows to the first solenoid from the fifth relay. Electric current from the first solenoid 114*a* flows to a sixth relay 154, which is also normally closed, and then through the normally closed full override switch 99 to a common ground 156. A diode 158 is connected in parallel with the first solenoid 114*a* to prevent damage thereto upon the opening and closing of switches 94, 96.

The timer device 100 is preferably equipped with internal circuitry to monitor a plurality of parameters, such as duration of fan pitch reversal and the duration of time between fan pitch reversal. To this end, the relay contact 101 is controlled by the timer device 100, which is programmed to maintain the relay contact in an open position for a predetermined period of time, and then briefly close the relay contact for a predetermined duration, following which the relay contact will resume its open position. It is contemplated that the predetermined period of time in which the relay contact 101 is open and the predetermined duration during which the relay contact is closed could be modified to suit individual applications. The timer device 100 may include a 15A fuse to protect the timer device from the power source. For example, in one embodiment, the timer device 100 is programmed to maintain the relay contact 101 in the open position for 20 minutes, and following the elapsing of 20 minutes, the timer device closes the relay contact for a period of 8 seconds. After 8 seconds, the relay contact 101 resumes its open position. Thus, current is prevented from flowing to the second solenoid 116*a* for 20 minutes, following which time current flows to the second solenoid to activate the second solenoid for a duration of 8 seconds. Then the second solenoid 116*a* is shorted when the relay contact 101 opens once again.

Only when the relay contact 101 is closed for the predetermined duration will electric current to flow from the timer contact to the fourth relay 160. Electric current from the fourth relay 160 flows to both a purge cycle indicator 162, which may be a filament, and to the second solenoid 116*a*, which is connected in parallel to the indicator 162. Because electric current flows to both the purge cycle indicator 162 and the second solenoid 116*a*, and because electric current flowing through the second solenoid 116*a* usually effects a full purge blade pitch position, the purge cycle indicator should usually illuminate to indicate that a purge cycle is commencing. Similar to the first solenoid 114*a*, the second solenoid 116*a* has a diode 164 in parallel therewith to prevent damage to the solenoid 116*a* upon opening and closing of the relays 148 and 160, for example. From the second solenoid 116*a*, electric current flows to the common ground 156.

In operation of the above-described embodiment of the electronic control device 10, actuating the vehicle ignition enables electric current to flow through the normally closed switches 94, 96, 99, the relays 146, 148, 150, 152, 154, 160 and to the relay contact 101 when the relay contact is closed.

Typically, when the vehicle ignition is activated, the timer device 100 will begin tolling the predetermined time period, which in one embodiment is 20 minutes. Since the timer device 100 will not signal the relay contact 101 to close until 20 minutes has elapsed, the relay contact is generally in the open position when the vehicle ignition is activated, and will prevent current flow to the second solenoid 116*a*. Air from the second valve 116 is therefore diverted to the exhaust air out passageway 124. However, the switches 94, 96, 99 are typically closed when the vehicle ignition is actuated, and therefore only the first solenoid 114*a* will usually be actuated when the vehicle ignition is actuated. Consequently only the first valve 114 will usually close to allow compressed air from the first valve to reach the shuttle valve 120. The shuttle valve 120 will therefore be displaced in the direction of air flowing from the first valve 114, which is the low pressure solenoid control valve. In this manner, the instant electronic control device 10 may be configured so that actuating the vehicle ignition actuates the fan blades 28 to a full neutral blade pitch position.

After 20 minutes elapse, the relay contact 101 is closed, allowing current to flow through the relay contact 101 to the second solenoid 116*a*. Assuming that the normally closed temperature and air conditioner pressure switches 94, 96 are both in the closed position, electric current therefore flows to the first solenoid 114*a* and the second solenoid 116*a* for as long as the relay contact 101 remains open, which in the instant embodiment is determined to be 8 seconds. For the predetermined duration of 8 seconds, both the first and second solenoids 114*a*, 116*a* are energized, which in turn actuates both the first and second valves 114, 116. In response, both the first and second valves 114, 116 close, and compressed air flows from each valve to the shuttle valve 120. However, since the valve assembly 92 is configured so that the second valve 116 is a higher pressure valve than the first valve 114, the shuttle valve 120 will be displaced in the direction of air flow from the second valve. In this manner, the instant electronic control device 10 may be configured so that closing the relay contact 101 while maintaining the temperature and air conditioner switches 94, 96 in the normally closed positions actuates the fan blades 28 to a full purge blade pitch position. The fan blades 28 will remain in the full purge blade pitch position until the predetermined duration of 8 seconds has elapsed, at which time the relay contact 101 will open, shorting the second solenoid 116*a*. Since current is still flowing to the first solenoid 114*a*, the shuttle valve 120 will then be displaced in the direction of air flowing from the first valve 114 only, which returns the fan blades to a neutral blade pitch position for another predetermined time period of 20 minutes. The cycle can be repeated indefinitely.

As previously discussed, one embodiment of the instant invention includes the temperature switch 94 coupled to an engine block to sense when a predetermined temperature condition has been reached by the engine block, for example 150° Fahrenheit. At that time, the temperature sensing means may cause the temperature switch 94 to open. When the temperature switch 94 opens, electric current is prevented from flowing through the temperature switch, including the first solenoid 114*a*, which consequently opens the first valve 114 to exhaust air through the exhaust passageway 124.

Similarly, detection of a predetermined pressure condition by the air conditioner pressure switch 96 may cause the air conditioner pressure switch 96 to open, which prevents electric current from flowing through the air conditioner pressure switch, including to the first solenoid 114*a*. Thus, when either one or both of the temperature switch 94 and the air conditioner pressure switch 96 are open, the first solenoid 114*a* is shorted, preventing actuation of the first valve 114.

Thus, assuming that either one or both of the temperature or air conditioner pressure switches 94, 96 are open, and assuming that the predetermined time period of 20 minutes has not elapsed to trigger the closing of the relay contact 101, current is prevented from flowing to either the first or second solenoids 114*a*, 116*a*. Like the first valve 114, the second valve 116 is therefore also open and air is exhausted out through the exhaust passageway 124. Thus, no air reaches the shuttle valve 120, which is therefore not displaced in either direction. In this manner, the instant electronic control device 10 may be configured so that opening of either the temperature or air conditioner pressure switches 94, 96 while the relay contact 101 is open will result in a full cooling fan blade pitch position. However, once 20 minutes has elapsed, and the relay contact 101 closes, assuming that one or both of the switches 94, 96 are still open, electric current will flow to the second solenoid 116*a* to effect a full purge blade pitch position for 8 seconds, at which time it will return to the full cooling fan blade pitch position.

Optionally, the present invention may include the manual override switch 99, where a vehicle operator is able to manually open the normally closed override switch. By pressing a button, flipping a switch, or other satisfactory signaling methods, the operator actuates the override switch 99 to open the override switch. Since the override switch 99 is last in series before the common ground 156, the entire circuit is broken. Neither the first nor the second valves 114, 116 close, and the psi drops to zero, effecting a full cooling blade pitch position. In this way, the operator may, at will, set the fan to a full cooling blade pitch position, regardless of the respective positions of the temperature switch 94, the air conditioner pressure switch 96, or the relay contact 101.

Figure 6:
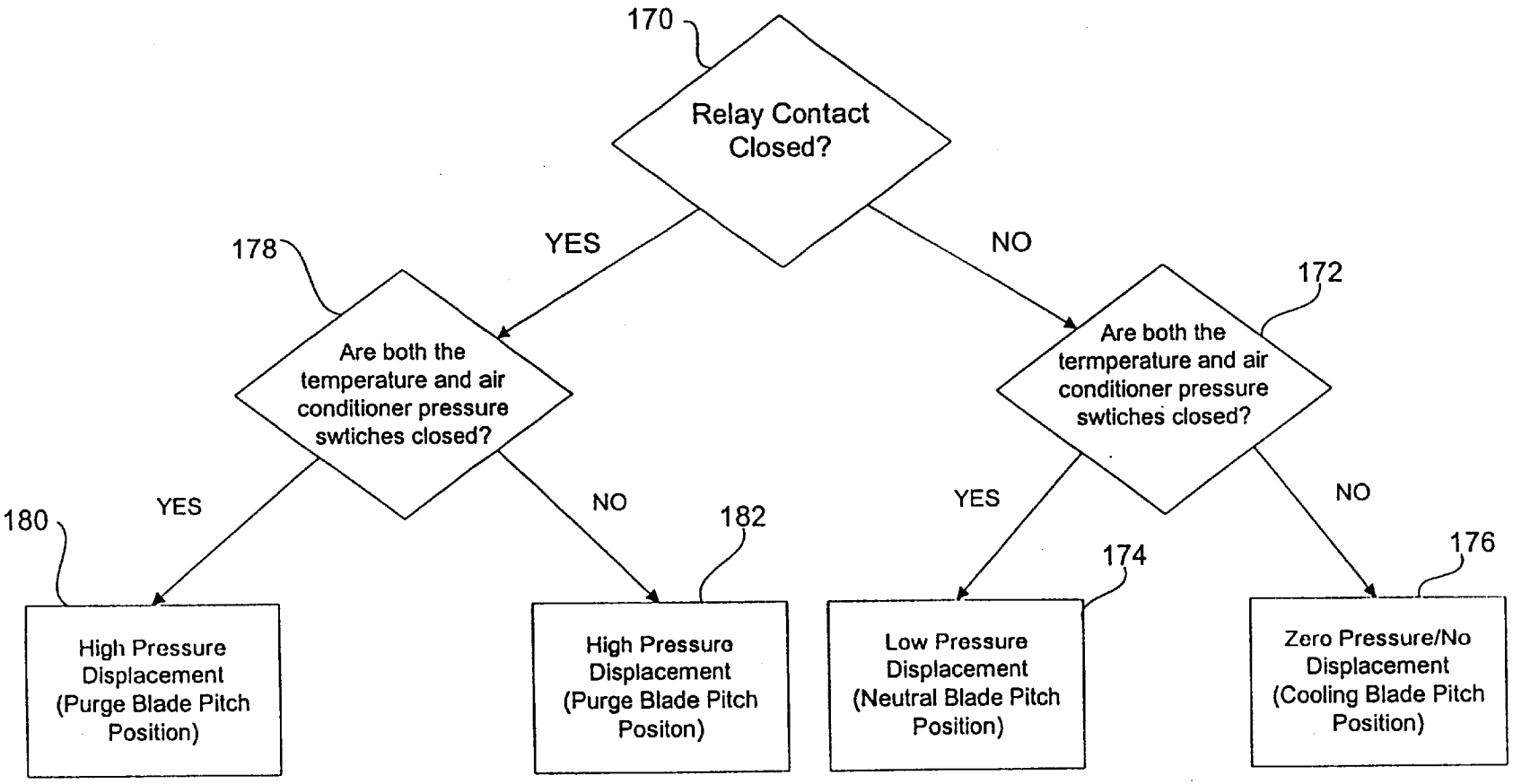
FIG. 6 is a flow chart illustrating one embodiment of the present invention.

In summary of the above-described embodiment, the flow chart illustrated in FIG. 6 illustrates the ultimate effect upon the fan assembly 12 by direction of the instant electronic control device 10. When system power is supplied to the electronic control device 10 by vehicle ignition or other means, a first step 170 is determining whether the timer contact 101 is in the open or closed position. Assuming for the moment that the timer contact is open, it may then be determined whether or not both the temperature switch 94 and air conditioner pressure switch 96 are both in the normally closed position (step 172). If both switches 94, 96 are closed, low pressure displacement of the shuttle valve 120 results in a neutral blade pitch position (step 174). However, if either one or both of the temperature or air conditioner pressure switches 94, 96 are open, there is no displacement of the shuttle valve, resulting in a full cooling blade pitch position (step 176).

However, if the relay contact is closed at step 170, it may then be determined whether both of the temperature and air conditioner pressure switches 94, 96 are also in the normally closed positions (step 178). If both switches 94, 96 are closed, there is high pressure displacement of the shuttle valve, resulting in a full purge blade pitch position (step 180). Similarly, if either one or both of the temperature or air conditioner pressure switches 94, 96 are open, there will still be displacement of the shuttle valve 120 in the direction of air travel from the second valve 116, and a full purge blade pitch position will again be achieved for as long as the relay contact 101 remains closed. Thus, closing the relay contact 101 following the predetermined period of time results in a full purge blade pitch position, regardless of the position of the temperature and air conditioner pressure switches 94, 96.

While a particular embodiment of the electronic control device has been shown and described, it will be appreciated by those skilled in the art that changes and modifications may be made thereto without departing from the invention in its broader aspects and as set forth in the following claims.

What is claimed is:

1. An electronic control device for opening and closing valves in a valve assembly that actuates a variable pitch fan system capable of operating in a plurality of fan blade pitch positions comprising:

a temperature switch actuated in response to a temperature condition of the engine;

a pressure switch in series with said temperature switch and actuated in response to a pressure condition of the variable pitch fan system;

a time delay relay control in parallel with said temperature switch and said pressure switch for transmitting a timed signal therefrom;

a first solenoid in series with said pressure switch;

a second solenoid in series with said time delay relay control and connected to said first solenoid; and wherein transmission of at least one of said timed signal, said temperature condition signal, and said pressure condition signal opens or closes the valves of the valve assembly of the variable pitch fan system.

2. The electronic control device of claim 1 further comprising a first diode connected in parallel with said first solenoid and a second diode connected in parallel with said second solenoid.

3. The electronic control device of claim 1 further comprising a plurality of relays connected in series with said temperature switch.

4. The electronic control device of claim 3 wherein said plurality of relays includes a first relay, a third relay, a fifth relay and a sixth relay connected in series with said temperature switch.

5. The electronic control device of claim 4 further comprising a second relay and a fourth relay, both of said relays being connected in parallel with said third and fifth relays.

6. The electronic control device of claim 1 further comprising a full override switch.

7. The electronic control device of claim 1 further comprising a cycle indicator connected in parallel with said second solenoid.

8. The electronic control device of claim 7 wherein said cycle indicator is a filament.

9. The electronic control device of claim 1 further comprising a fuse connected in series with said temperature switch.

10. A method of selectively controlling a pitch of a variable pitch fan of the type capable of operating in a normal operating blade pitch position, a cooling blade pitch position, and a purge blade pitch position for controlling a direction of air flow to and from a cooling core comprising:

selecting a predetermined temperature parameter;

monitoring a predetermined location for detection of said predetermined temperature parameter;

actuating a valve assembly in response to detection of said predetermined temperature parameter to alter the pitch of the variable pitch fan.

11. The method of claim 10 wherein said predetermined temperature parameter is selected to be at least 150° Fahrenheit.

12. The method of claim 10 wherein said valve assembly comprises a low pressure solenoid for positioning the variable pitch fan in the neutral blade pitch position, and a high pressure solenoid for the variable pitch fan in the purge blade pitch position.

13. The method of claim 10 further comprising selecting a predetermined pressure parameter for indicating a pressure condition.

14. The method of claim 13 further comprising the step of actuating the low pressure solenoid upon detection of said predetermined temperature parameter or said predetermined pressure parameter.

15. The method of claim 13 further comprising the step of actuating the high pressure solenoid upon detection of an elapsed predetermined time period.

16. A method of periodically changing a pitch of a variable pitch fan assembly mounted to a vehicle having an engine and an air conditioner system and configured for selectively controlling the direction of air flow to and from a cooling core comprising:

selecting a predetermined temperature parameter for indicating a temperature condition of the engine;

selecting a predetermined pressure parameter for indicating a pressure condition of the engine;

determining whether a relay contact is closed and if so, energizing a high pressure solenoid to close a high pressure valve, otherwise;

determining whether said temperature condition exists and if so, opening a temperature switch to de-energize a low pressure solenoid and open a low pressure valve, otherwise;

determining whether said pressure condition exists and if so, opening a pressure switch to de-energize the low pressure solenoid and open the low pressure valve, otherwise;

energizing both the low and high pressure solenoids to close both the low and high pressure valves.

17. The method of claim 16, further comprising the step of determining whether a predetermined time period has elapsed, and if so, de-energizing the high pressure solenoid for a predetermined duration.

18. The method of claim 17 wherein said predetermined duration is at least 8 seconds.

19. An electronic control device for selectively controlling a pitch of a variable pitch fan of the type used to cool an engine and actuated by a valve assembly and capable of operating in at least one of a normal operating blade pitch position, a cooling blade pitch position, and a purge blade pitch position comprising:

means for detecting a predetermined temperature of an engine;

means for detecting a predetermined pressure in an air conditioning system;

timed signal means for transmitting a signal for a predetermined duration following a predetermined time period;

actuating means for actuating the valve assembly when at least one of temperature, pressure or time period has been reached; and actuating means for actuating said valve assembly.

* * * * *

UNITED STATES PATENT AND TRADEMARK OFFICE

CERTIFICATE OF CORRECTION

PATENT NO. : 6,729,844 B2
DATED : May 4, 2004
INVENTOR(S) : Bettencourt

It is certified that error appears in the above-identified patent and that said Letters Patent is hereby corrected as shown below:

Column 15,
Line 9, replace “engine” with -- air conditioner system --

Signed and Sealed this

Twenty-eighth Day of September, 2004

JON W. DUDAS
*Director of the United States Patent and Trademark Office*